United States Patent [19]

Stock et al.

[11] 4,363,301

[45] Dec. 14, 1982

[54] BRAKING DEVICE FOR A FOUR-CYCLE ENGINE OF A VEHICLE

[75] Inventors: Hugo Stock; Paul Tholen, both of Bergisch Gladbach, Fed. Rep. of Germany

[73] Assignee: Klöckner-Humboldt-Deutz Aktiengesellschaft, Cologne, Fed. Rep. of Germany

[21] Appl. No.: 234,326

[22] Filed: Feb. 13, 1981

[30] Foreign Application Priority Data

Feb. 14, 1980 [DE] Fed. Rep. of Germany ..... 3005456

[51] Int. Cl.[3] ..... F02D 9/06

[52] U.S. Cl. ..... 123/321; 123/323; 123/90.14; 123/90.15

[58] Field of Search ..... 123/321, 323, 345, 347, 123/90.14, 90.15, 90.16, 90.24, 90.32, 198 F; 188/273

[56] References Cited

U.S. PATENT DOCUMENTS 2,342,003 2/1944 Meyer ..... 123/90.14

FOREIGN PATENT DOCUMENTS 1133600 7/1962 Fed. Rep. of Germany .

2143724 9/1971 Fed. Rep. of Germany ..... 123/323

485233 11/1975 U.S.S.R. ..... 188/273

*Primary Examiner*—William A. Cuchlinski, Jr.

*Attorney, Agent, or Firm*—Becker & Becker, Inc.

[57] ABSTRACT

A braking device for a four-cycle engine of a vehicle, particularly for an internal combustion Diesel engine, with a motor brake adjustment member which is connected with a shutoff element in the exhaust conduit and with a control element in a pressure conduit. Pressure cylinders are associated with the exhaust valves and are connected to the pressure conduit after the control element. Compensating pistons are respectively connected with the valve shafts and are subjected to pressure in the pressure cylinders for closing the exhaust valves. The motor brake adjustment member has a first adjustment range for actuating the shutoff element, and a second adjustment range for actuating the control element.

8 Claims, 4 Drawing Figures

BRAKING DEVICE FOR A FOUR-CYCLE ENGINE OF A VEHICLE

The present invention relates to a braking device for a four-cycle engine of a vehicle, particularly for an internal combustion Diesel engine, with a motor brake adjustment member which is connected with a shutoff element in the exhaust conduit and with a control element in a pressure condiut; pressure cylinders are associated with the exhaust valves and are connected to the pressure conduit after the control element; equalizing or compensating pistons are respectively connected with the valve shafts and are subjected to pressure in the pressure cylinders for closing the exhaust valves.

A shutoff element in the exhaust conduit is closed upon actuation of the motor brake by a pedal or the like, and the pistons must push out against the pressure head which is building up, whereby the braking effect is attained. In the intake cycle of the individual cylinders, there exists the danger that this pressure head will open an otherwise closed exhaust valve in an uncontrolled manner, and that the braking effect will be lost by way of a return flow of compressed air from the exhaust flow by way of the intake valve. A device is known with which an equalizing piston in a pressure cylinder of valve diameter is connected with the exhaust valve, which may be subjected to a counterpressure for closing the valve, and with which a connecting conduit from the exhaust conduit to the pressure cylinder is provided with a control element which simultaneously opens this conduit upon closing of the shutoff element in the exhaust conduit (German Auslegeschrift No. 11 33 600). This feature is to assure that in motor load operation, no exhaust gas flows into the pressure cylinders, so that at this location no carbon can deposit. In motor braking operations, the control element is opened and the equalizing piston is subjected to an overpressure. Only two extreme positions are provided for the control element by way of the mechanical connection just as for the generally pneumatically acuated shutoff element in the exhaust conduit. The greater the exhaust counterpressure, the more suddenly or in a shock-like manner does the braking effect occur. A lifting of the exhaust valves is not possible under such circumstances, since the respective equalizing pistons are subjected to at least the pressure acting from above, upon the exhaust valve.

It is an object of the present invention to provide a braking device, for a four-cycle engine of a vehicle, which makes possible a dosed or quantitatively regulated braking effect of the motor, especially with conventional actuation of the shutoff element in the exhaust conduit with two positions against the abutments or stops.

This object, and other objects and advantages of the present invention, will appear more clearly from the following specification in connection with the accompanying drawings, in which.

Figure 1:
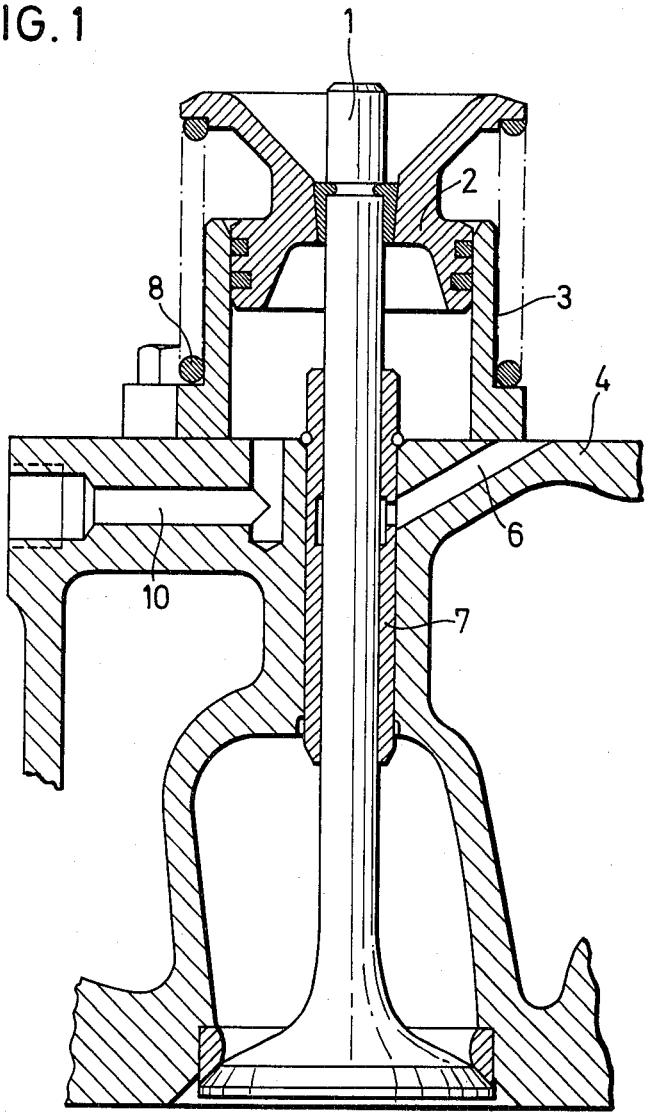
FIG. 1 shows an exhaust valve with a pressur cylinder and external valve spring means.

The braking device of the present invention is characterized primarily in that the motor brake adjustment member has a first adjustment range for actuating the shutoff element, and a second adjustment range for actuating the control element, whereby the shutoff element is closed upon actuation and the control element is progressively opened. The manner of actuation of the two controls is a matter of choice. An actuation with stepped or surge-like transition is especially suitable for the shutoff element in the exhaust conduit, as for example a pneumatic cylinder or a spring loaded pull magnet. If the motor brake adjustment member is in the first adjustment range, the shutoff element, which is conventionally embodied as a simple throttle valve in the exhaust conduit, is preferably closed in a sudden or impact-like manner. If a multiple or stepless adjustment of the throttle valve is provided, there results a first possibility to dose the braking effect, since the counterpressure adjusts itself in the exhaust conduit, among other things, in conformity to the position of the throttle valve. Inventively the throttle valve, however, can also be closed in a sudden or impact-like manner upon actuation of the motor brake adjustment member without having the complete braking effect occur, since the control element in the pressure conduit is closed before the transition to the second adjustment range. This means that the equalizing pistons in the pressure cylinders exert no closing pressure upon the exhaust valves. The exhaust valves are consequently lifted by the pressure head in the exhaust conduit, as a result of which this pressure head decreases and adjusts ifself to a lower value, which is dependent upon the valve spring force and the underpressure in the cylinder in the intake cycle. If in the second adjustment range the control element in the pressure conduit inventively opens progressively, then the force effective for closing the exhaust valves increases by the extent of the gas pressure which is effective in the pressure cylinders upon the equalizing pistons. The lifting of the exhaust valves by the pressure head requires progressively higher opening values. The resulting pressure head, and hence the braking effect upon the motor, increases in a dosable manner. The actuation of the control element, which is in the pressure conduit and can be a conventional pressure control valve, occurs in a most simple and straightforward form purely mechanically with a suitable transmission, whereby the control element can be combined with the motor brake adjustment member in the space arrangement or in the structural embodiment.

According to the present invention, in a further embodiment, a venting of the pressure cylinder is provided during closing of the control element in the pressure conduit, or at the end of the braking procedure during opening of the shutoff element in the exhaust conduit. Preferably this is assured by the manner of construction of the control element.

In a special inventive embodiment, a venting conduit, which preferably proceeds from the unbranched pressure conduit, is arranged from the pressure cylinders to the crankcase housing. This is necessary particularly under circumstances where the pressure conduit is connected before the control element with the exhaust conduit before the shutoff element. This makes it possible to avoid deposits on the valve drive stemming from the exhaust gas.

In the connection of the pressure conduit with the exhaust gas system, there exists the simplest inventive possibility to furnish the pressure for the pressure cylinder, whereby in an advantageous manner the highest pressure upon the equalizing pistons always corresponds exactly to the pressure head effective upon the valve disc or plate. Consequently, on the one hand, the pressure necessary for securely closing the exhaust valves during full or complete braking action is assured, and on the other hand, the valve drive is not unnecessarily additionally loaded by an excessively elevated closing pressure.

A further possibility of feeding or supplying the pressure system exists in a connection of the pressure conduit with a compressed air generator, which is generally readily available for the service or operating brake of a vehicle. The advantage under these circumstances consists therein that no exhaust gas residue passes into the pressure cylinders, where the deposits from waste gas components can lead to increased wear.

The actuation of the control element by the motor brake adjustment member occurs in accordance with the desired braking operation. In a simple inventive embodiment, the control element is a pressure control valve with which the pressure drop is changed by the adjusting path. If the pressure conduit is connected to a compressed air source which generates a pressure far above the pressure head in the exhaust gas conduit, and which also supplies further consumers, then a pressure reducing valve is inventively installed as a control element in the pressure conduit, with which valve a change of the supply or inlet pressure is not effective upon the output pressure for the pressure cylinders. This is necessary in order to preclude an influencing of the braking effect by a sudden pressure drop upon connection of a different consumer to the compressed air generator.

Figure 2:
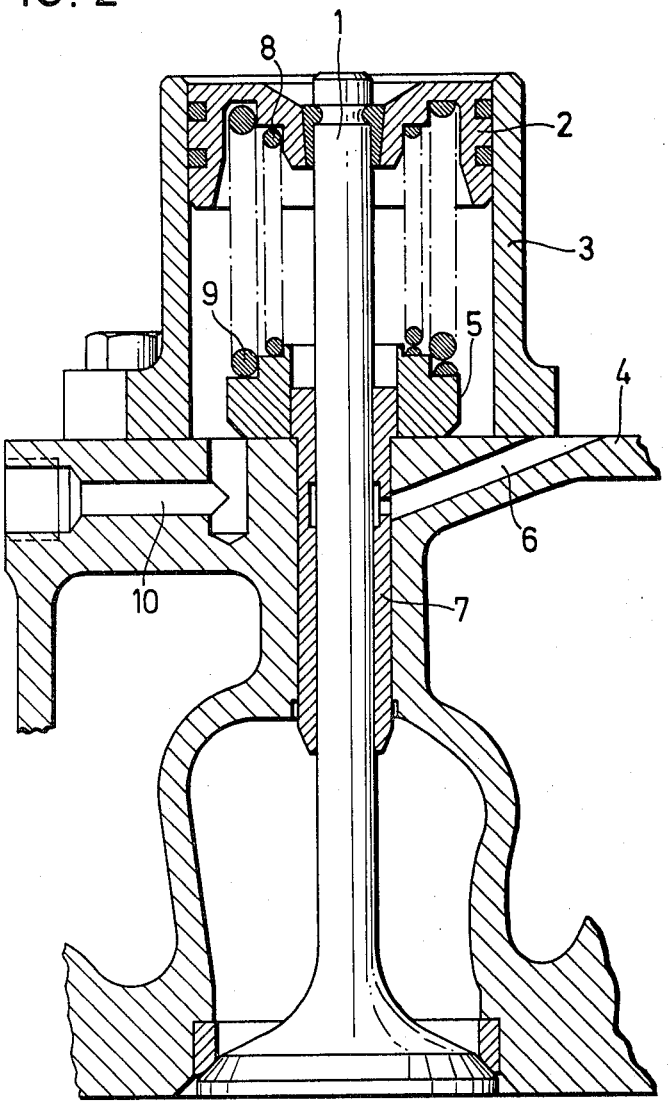
FIG. 2 shows an exhaust valve with a pressure cylinder and internal valve spring means.

Referring now to the drawings in detail, FIGS. 1 and 2 respectively show an exhaust valve 1 suitable for being acted upon by means of a braking device in accordance with the present invention. A compensating piston 2 is secured to the shaft of the exhaust valve 1 and sealingly slides in a pressure cylinder 3. The pressure cylinder 3 is connected with the cylinder head 4 by screw means. The valve springs 8 or 9 act on the compensating piston 2 in an upward direction. The valve springs 8,9 press the exhaust valve 1, with the valve disc or plate, against the seating surface. The valve spring 8 is supported at the bottom on the pressure cylinder 3 according to FIG. 1, and the valve spring 9 is supported on a lower valve spring retainer or plate 5 according to FIG. 2. In both cases, a bore 6 is additionally provided in the cylinder head for lubricating the valve guide means 7. The pressure on the upper side of the valve retainer or plate rises by closing a throttle valve in the exhaust conduit upon actuation of the motor-braking device in the first stage. Consequently, the valve is periodically lifted against the force of the valve springs at nominal pressure in the combustion chamber. The braking effect is consequently reduced. In the second actuating stage of the motor-braking device, the pressure cylinder 3 is therefore acted upon with elevated pressure by way of the conduit 10 in the cylinder head 4. An overpressure occurs at the underside of the compensating piston 2; this overpressure supports the closing force of the valve springs, so intermittent uncontrolled opening of the exhaust valve is precluded with an opened inlet valve, and consequently the motor-braking effect is increased.

Figure 3:
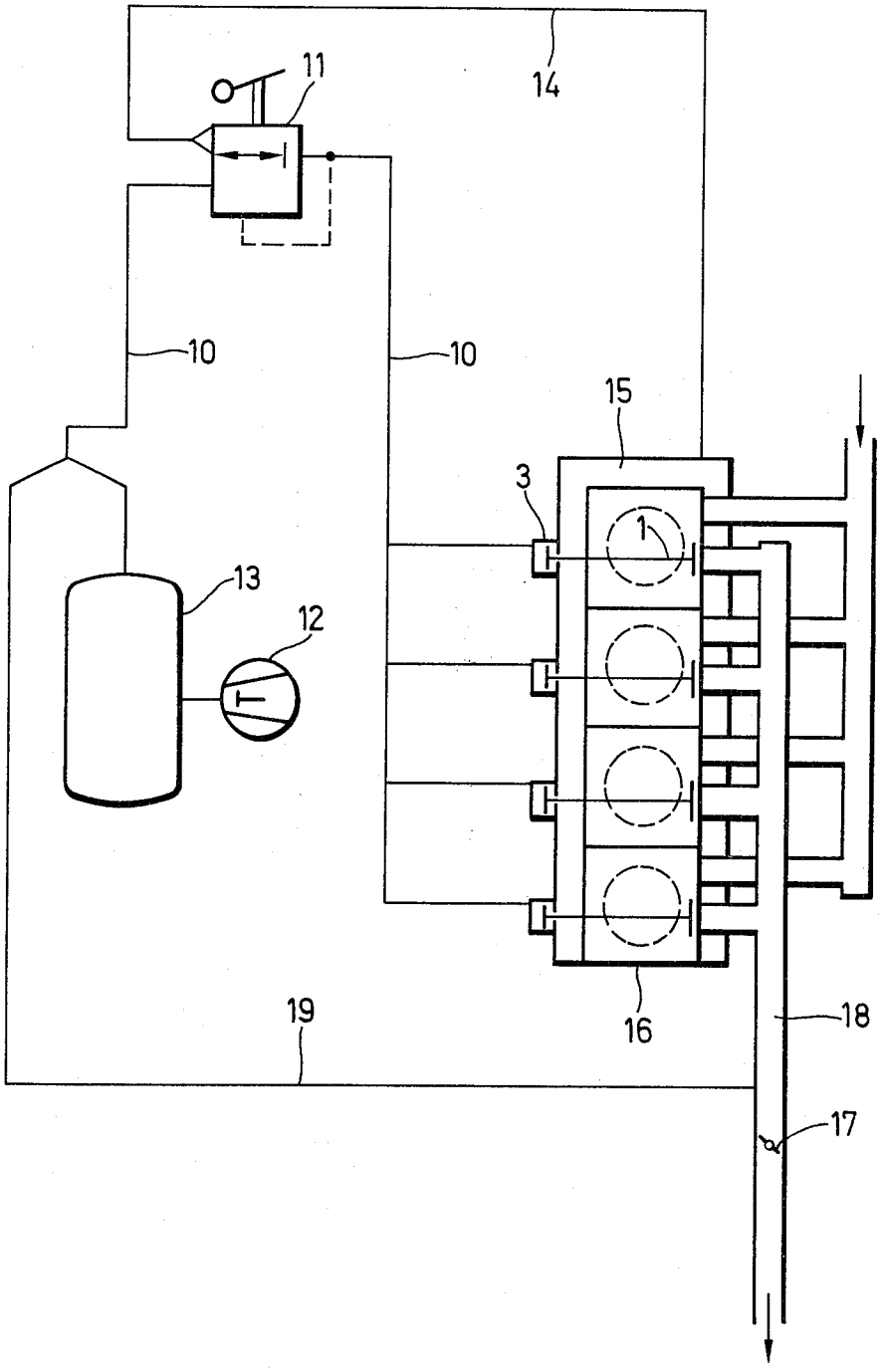
FIG. 3 shows the schematic arrangement of the system with two varying embodiments.

FIG. 3 schematically illustrates a four-cylinder internal combustion engine 16 having an exhaust conduit 18 in which a shutoff element 17 is arranged. A pressure conduit 10, which leads to the pressure cylinders 3 of the exhaust valves 1 (illustrated in greater detail in FIGS. 1 and 2), is controlled by a control element 11. The pressure conduit 10 is connectible either with the storage tank 13 of an external compressed air source 12, for instance a compressor driven by a motor, or, in an alternative embodiment of construction, is connectible by way of a connecting line 19 with the exhaust conduit 18 ahead of the shutoff element 17. Prior to actuation of the motor-braking device, the shutoff element 17 in the exhaust conduit 18 is opened, the control element 11 within the path of the pressure conduit 10 is closed; opened, however, is a connection from that portion of the pressure conduit 10 on the cylinder side to a venting conduit 14 which leads into the crankcase housing 15 of the internal combustion engine 16. Upon actuation of the braking device, in the first adjustment or setting region the shutoff element 17 is at first closed; in the second setting or adjustment region, the control element 11 is additionally opened in the path of the pressure conduit 10, while the connection to the venting conduit 14 is closed. Consequently, the compensating cylinder means 3 is acted upon by pressure.

Figure 4:
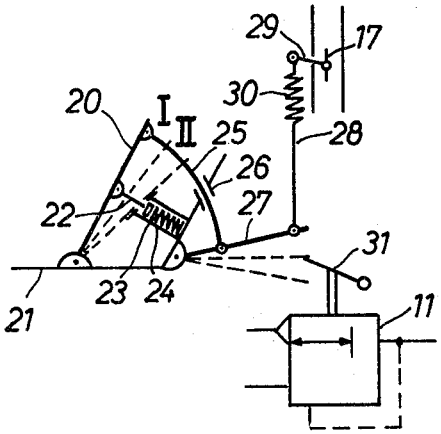
FIG. 4 shows the connection of the motor brake adjustment member with the shutoff element and the control element.

In FIG. 4, the motor brake adjustment member is illustrated as a pivotable brake pedal 20 which is pivoted or joined to a bottom plate 21 and is supported thereagainst by a rod 22 and a return spring 23. The guide cylinder 24 for the return spring 23 simultaneously serves as an abutment for the brake pedal 20. The brake pedal 20 is connected with a transfer lever 25 which is guided in a guide 26 in the bottom plate 21, and in turn is pivotably connected with the actuating lever 27. A pull rod or tie rod 28 is linked to the movable end of the actuating lever 27; this tie rod 28 acts on a closing lever 29 of the shutoff element 17. A spring 30 is interposed between the tie bar 28 and the closing lever 29. The shutoff element 17 is provided with a non-illustrated reset mechanism for occupying the open position illustrated. The opening lever 31 of the control element 11 is located at a predetermined distance from the end of the actuating lever 27. When the brake pedal 20 or the actuating lever 27 passes over the first setting or adjustment range I, the shuttoff element 17 is closed. The shutoff element 17 remains closed during further actuation of the brake pedal 20 or the actuating lever 27 therebeyond as far as to the end of the setting or adjustment range II, in which connection the spring 30 permits a further movement of the tie rod 28. The actuating lever 27 now engages the opening lever 31 of the control element 11, which is increasingly opened until the actuating lever 27 reaches the end of the setting or adjustment range II. The procedure or sequence occurs in reverse order when the brake pedal is released. The embodiment is set forth only as an example, since the functions can also be illustrated in a different manner.

In summary, the present invention provides a braking device for a four-cycle engine of a vehicle, particularly for an internal combustion Diesel engine, with a motor brake adjustment member which is connected with a shutoff element 17, in the exhaust conduit 18 and with a control element 11 in a pressure conduit 10. Pressure cylinders 3 are associated with the exhaust valves 1 and are connected to the pressure conduit 10 after the control element. Compensating pistons 2 are respectively connected with the valve shafts and are subjected to pressure in the pressure cylinders for closing the exhaust valves. The motor brake adjustment member has a first adjustment range for actuating the shutoff element 17, and a second adjustment range for actuating the control element 11. The pressure conduit 10 may be connected before the control element 11 with the exhaust conduit 18 before the shutoff element 17. The pressure conduit 10 may also be connected with a compressed air source 12 ahead of the control element 11. The pressure cylinders 3, in the starting position of the motor brake adjustment member, may be connected by way of the control element 11 or a further valve with a venting conduit 14, especially one leading to the crankcase housing 15 of the internal combustion engine 16. The control element 11 may be a pressure regulating valve which changes the pressure drop as a function of the adjustment path. Alternatively, the control element 11 may be a pressure reducing valve which changes the output pressure as a function of the adjustment path. Alternatively, the control.

The present invention is, of course, in no way restricted to the specific disclosure of the specification and drawings, but also encompasses any modifications within the scope of the appended claims.

What we claim is:

1. A braking device for a four-cycle engine of a vehicle, particularly for an internal combustion Diesel engine, having a motor brake adjustment member, and respective exhaust valves for the cylinders of said engine, said exhaust valves having valve shafts, said braking device comprising:

pressure cylinders respectively associated with said exhaust valves;

an exhaust conduit connected to said exhaust valves and provided with a shutoff element which is connected to said motor brake adjustment member;

a pressure conduit connected to said pressure cylinders and provided with a control element which is likewise connected to said motor brake adjustment member, said connection of said pressure cylinders with said pressure conduit occurring after said control element; and compensating pistons respectively connected to said valve shafts and associated with said pressure cylinders, said pistons being subjected to pressure in said pressure cylinders for closing said exhaust valves thereby preventing uncontrolled lifting thereof, said motor brake adjustment member having a first adjustment range for actuating said shutoff element, and a second adjustment range for actuating said control element.

2. A braking device for a four-cycle engine of a vehicle, particularly for an internal combustion Diesel engine, having a motor brake adjustment member, and respective exhaust valves for the cylinders of said engine, said exhaust valves having valve shafts, said braking device comprising:

pressure cylinders respectively associated with said exhaust valves;

an exhaust conduit connected to said exhaust valves and provided with a shutoff element which is connected to said motor brake adjustment member;

a pressure conduit connected to said pressure cylinders and provided with a control element which is likewise connected to said motor brake adjustment member, said connection of said pressure cylinders with said pressure conduit occurring after said control element; and compensating pistons respectively connected to said valve shafts and associated with said pressure cylinders, said pistons being subjected to pressure in said pressure cylinders for closing said exhaust valves, said motor brake adjustment member having a first adjustment range for actuating said shutoff element, and a second adjustment range for actuating said control element, said pressure conduit being connected with said exhaust conduit ahead of said control element and ahead of said shutoff element.

3. A braking device for a four-cycle engine of a vehicle, particularly for an internal combustion Diesel engine, having a motor brake adjustment member, and respective exhaust valves for the cylinders of said engine, said exhaust valves having valve shafts, said braking device comprising:

pressure cylinders respectively associated with said exhaust valves;

an exhaust conduit connected to said exhaust valves and provided with a shutoff element which is connected to said motor brake adjustment member;

a pressure conduit connected to said pressure cylinders and provided with a control element which is likewise connected to said motor brake adjustment member, said connection of said pressure cylinders with said pressure conduit occurring after said control element; and compensating pistons respectively connected to said valve shafts and associated with said pressure cylinders, said pistons being subjected to pressure in said pressure cylinders for closing said exhaust valves, said motor brake adjustment member having a first adjustment range for actuating said shutoff element, and a second adjustment range for actuating said control element, said pressure conduit being connected with a source of compressed air ahead of said control element.

4. A braking device according to claim 3, in which said control element is a pressure regulating valve which changes the pressure drop as a function of the adjustment path.

5. A braking device according to claim 3, in which said control element is a pressure reducing valve which changes the output pressure as a function of the adjustment path.

6. A braking device for a four-cycle engine of a vehicle, particularly for an internal combustion Diesel engine, having a motor brake adjustment member, and respective exhaust valves for the cylinders of said engine, said exhaust valves having valve shafts, said braking device comprising:

pressure cylinders respectively associated with said exhaust valves;

an exhaust conduit connected to said exhaust valves and provided with a shutoff element which is connected to said motor brake adjustment member;

a pressure conduit connected to said pressure cylinders and provided with a control element which is likewise connected to said motor brake adjustment member, said connection of said pressure cylinders with said pressure conduit occurring after said control element; and compensating pistons respectively connected to said valve shafts and associated with said pressure cylinders, said pistons being subjected to pressure in said pressure cylinders for closing said exhaust valves, said motor brake adjustment member having a first adjustment range for actuating said shutoff element, and a second adjustment range for actuating said control element, a venting conduit, and in the starting position of said motor brake adjustment member, said pressure cylinders being connected with said venting conduit via said control element.

7. A braking device for a four-cycle engine of a vehicle, particularly for an internal combustion Diesel engine, having a motor brake adjustment member, and respective exhaust valves for the cylinders of said engine, said exhaust valves having valve shafts, said braking device comprising:

pressure cylinders respectively associated with said exhaust valves;

an exhaust conduit connected to said exhaust valves and provided with a shutoff element which is connected to said motor brake adjustment member;

a pressure conduit connected to said pressure cylinders and provided with a control element which is likewise connected to said motor brake adjustment member, said connection of said pressure cylinders with said pressure conduit occurring after said control element; and compensating pistons respectively connected to said valve shafts and associated with said pressure cylinders, said pistons being subjected to pressure in said pressure cylinders for closing said exhaust valves, said motor brake adjustment member having a first adjustment range for actuating said shutoff element, and a second adjustment range for actuating said control element, a venting conduit and a further valve, and in the starting position of said motor brake adjustment member, said pressure cylinders being connected with said venting conduit via said further valve.

8. A braking device according to claim 6 or 7, in which said engine has a crankcase housing, said venting conduit leading to said crankcase housing.

* * * * *